United States Patent [19]

Labbe

[11] 4,024,878

[45] May 24, 1977

[54] CIGARETTE MAKING MACHINES

[75] Inventor: Francis A. M. Labbe, Neuilly-sur-Seine, France

[73] Assignee: Molins Limited, London, England

[22] Filed: Jan. 29, 1976

[21] Appl. No.: 653,327

[30] Foreign Application Priority Data

Feb. 1, 1975 United Kingdom ..... 4439/75

[52] U.S. Cl. ..... 131/84 B; 131/110; 209/45

[51] Int. Cl.[2] ..... A24C 5/18

[58] Field of Search ..... 131/84, 110, 109, 108; 209/45, 138, 139, 250

[56] References Cited

UNITED STATES PATENTS

| | | | |
|---|---|---|---|
| 3,189,034 | 6/1965 | Molins | 131/110 X |
| 3,262,457 | 7/1966 | Gamberini | 131/110 X |
| 3,727,755 | 4/1973 | Cristiani | 209/45 |
| 3,779,253 | 12/1973 | Labbe | 131/110 |

*Primary Examiner*—Stephen C. Pellegrino
*Attorney, Agent, or Firm*—John C. Smith, Jr.

[57] ABSTRACT

A continuous-rod cigarette-making machine of the type in which tobacco is conveyed from a hopper to a winnowing zone and there thrown across a rising airstream which entrains the tobacco and carries it up to the lower face of a suction conveyor on which a tobacco filler is formed has sealing means associated with conveying means for transporting the tobacco from the hopper to the winnowing zone, said sealing means opposing air flow between the hopper and the winnowing zone to reduce disturbance of the tobacco during its transport by the conveying means.

9 Claims, 1 Drawing Figure

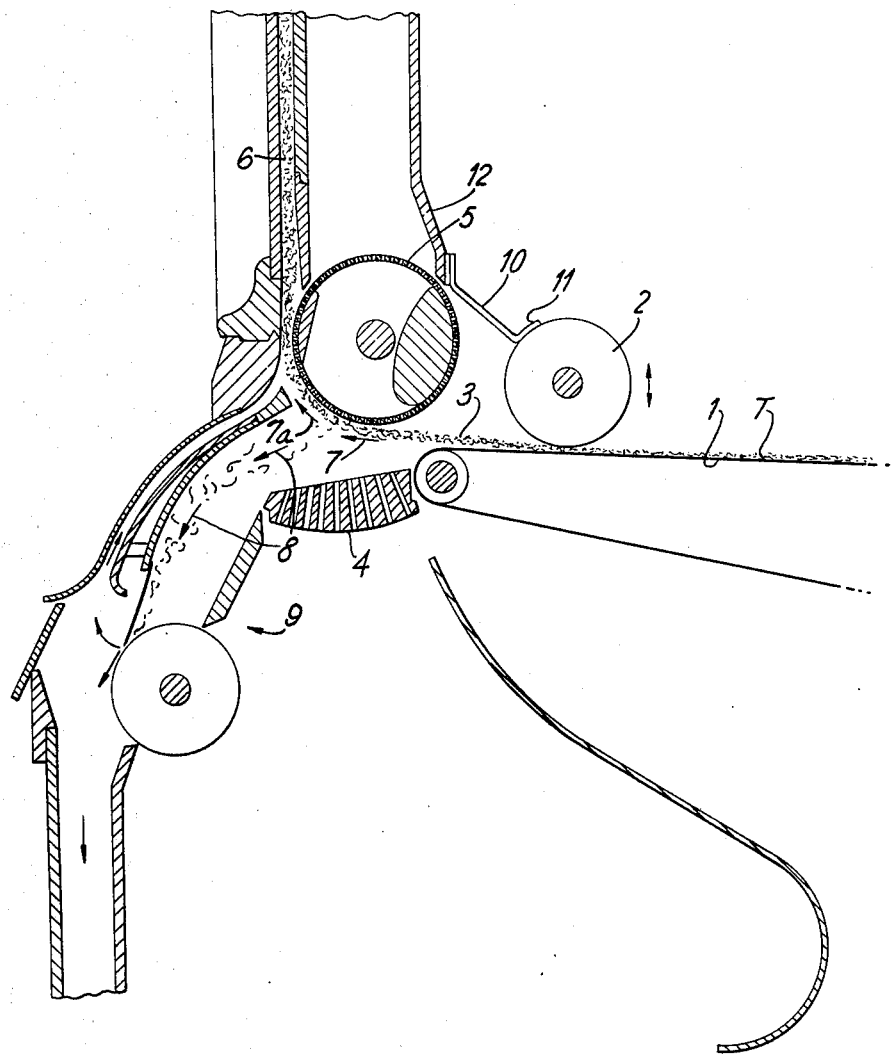
6
12
5
10
11
2
3
1
T
7a
7
8
4
9

CIGARETTE MAKING MACHINES

This invention relates to continuous-rod cigarette-making machines, and more particularly to such machines of the type in which the tobacco filler stream (which is wrapped to form a continuous cigarette rod and cut into discrete cigarettes) is formed by tobacco particles carried by an airstream to a suction conveyor. This mode of filler formation is disclosed in British patent specification No. 764,551 and has become well-known in the art by its use in the LOF and LOG machines made by Usines Decoufle and in the Molins Mark VIII and Mark IX machines.

In the aforesaid machines, tobacco fed from a hopper is thrown as separated particles in a generally horizontal direction across a rising airstream which entrains the tobacco and carries it up to the lower face of a suction conveyor belt. In the region where the tobacco enters the airstream a degree of winnowing occurs, whereby undesired heavy particles are discarded and drop away from the remainder of the tobacco which latter changes its direction of motion from substantially horizontal to substantially vertical. That region (hereinafter termed "the winnowing zone"), in a machine of the type defined, in which this action takes place is disclosed in detail in British patent specification No. 895,733.

A variety of factors influence the air velocities and pressures existing during operation at each point in a machine of the type defined. It is possible for satisfactory operation to require an air pressure in the winnowing zone which is different from the pressure in the hopper from which the tobacco is fed; in such conditions, the pressure difference causes air flow along the path of the tobacco leaving the hopper, and it will be appreciated that such air flow can give rise to unacceptable disturbance of the tobacco feed to the winnowing zone.

It is an object of the present invention to provide a machine of the type defined incorporating means for resisting undesired air flow between the hopper and the winnowing zone.

According to the invention, we provide a continuous-rod cigarette-making machine of the type defined, including sealing means associated with conveying means for transporting tobacco from a hopper to a winnowing zone, said sealing means being arranged to oppose flow of air between the hopper and the winnowing zone so as to reduce disturbance of the tobacco during its transport by the conveying means.

Preferably the conveying means is a conveyor belt arranged to carry the tobacco on an upper run and the sealing means is a rotatable roller extending across the upper run of the belt at right-angles to the length thereof, the spacing of the roller from the belt being such that tobacco carried by said upper run is not disturbed by the roller but no substantial air flow may occur between the roller and the belt. A flexible sealing member may then be provided above the roller to prevent air flow between the roller and a housing through which the belt passes. The belt is desirably substantially impervious to air, and the roller desirably is adjustable relative to the belt to allow for different rates of flow of tobacco.

In order that the invention may be well understood a preferred embodiment thereof will now be described with reference to the accompanying drawing, which shows (in somewhat diagrammatic manner) a side elevation of part of a continuous-rod cigarette-making machine. The relationship of the parts shown to the remainder of the machine may readily be seen by reference to the aforementioned British patent specification No. 895,733 (especially FIGS. 1 and 13).

As shown in the drawing, tobacco T is carried by an upper run 1 of a conveyor belt from a hopper (not shown) to the left, under a rotatable roller 2, and at the left-hand end of said upper run 1 the tobacco leaves the belt as separate particles 3 travelling in the directions indicated by arrow 7. As the tobacco continues travelling to the left, it enters a rising airstream travelling from holes in a preforated block 4 towards a perforated roller 5 and the adjacent lower end of a vertical passage 6. The effect of the rising airstream on the tobacco particles is to urge them upwards and the stream of tobacco particles follows an arcuate path indicated by arrow **7*a* so that the tobacco feeds into the passage 6, up which it travels to be deposited on the underside of a lower run of a porous conveyor band (not shown). Suction applied above said lower run serves to maintain a rising airstream in the passage 6** so that the tobacco ascends in said passage.

Arrows 8 indicate the path of undesired heavy particles in the tobacco discharged from the upper run 1 of the conveyor belt. Such heavy particles are less influenced by the rising airstream than are lighter particles, hence the direction of travel of the heavy particles is not changed sufficiently for them to reach the passage 6; instead, the heavy particles travel beyond the rising airstream and, as they pass out of its influence, move to the left in a descending path. The heavy particles which are thus winnowed out of the stream of tobacco descend to the region generally indicated at 9 where they are treated generally in the manner disclosed in British patent specification No. 1,038,551.

Above the roller 2 a flexible seal 10 is mounted on a housing wall 12. The seal 10 has its lower end 11 in engagement with roller 2 so that said seal (together with the housing of which wall 12 forms an upper part) prevents air flow above the roller 2 between the hopper (not shown) to the right of said roller 2 and the region bounded by the left-hand end of the run 1, the block 4, and the roller 5 (the winnowing zone). Air flow between the roller 2 and the upper run 1 of the conveyor belt is not possible to any material extent as the spacing between the roller 2 and upper run 1 is only sufficient to let the tobacco T pass without significant disturbance by the roller 2.

The presence of roller 2 and seal 11 prevents air flow between the hopper and the winnowing zone which would cause disturbance of the tobacco travelling from the hopper to the winnowing zone and thus permits more freedom in setting air flow and pressure conditions for satisfactory tobacco feed and winnowing than if air flow between the hopper and the winnowing zone were possible. Desirably, roller 2 is vertically adjustable (as indicated by the double headed arrow) to allow a proper spacing from upper run 1 to be obtained for different rates of tobacco feed.

Various changes or modifications are possible without departure from the scope of the invention. For example, the housing wall 12 may be so formed as to approach more closely the upper part of roller 2, so that seal 11 may be of smaller dimensions.

I claim:

1. In a continuous-rod cigarette-making machine with a suction conveyor on which a tobacco filler is formed in which tobacco is thrown as separated particles in a generally horizontal direction across a rising airstream in a winnowing zone so that said airstream entrains the tobacco and carries it up to the lower face of said suction conveyor, and with a hopper and conveying means for transporting the tobacco from said hopper to said winnowing zone, the improvement comprising sealing means associated with said conveying means, said sealing means being arranged to oppose flow of air between the hopper and the winnowing zone so as to reduce disturbance of the tobacco during its transport by the conveying means.

2. A machine as claimed in claim 1, in which the conveying means is a conveyor belt arranged to carry the tobacco on an upper run and the sealing means includes a rotatable roller extending across the upper run of the belt at right-angles to the length thereof, the spacing of the roller from the belt being such that tobacco carried by said upper run is not disturbed by the roller but no substantial air flow may occur between the roller and the belt.

3. A machine as claimed in claim 2, including a housing through which said conveyor belt passes and in which said sealing means further includes a flexible seal above the roller to prevent air flow between said roller and said housing.

4. A machine as claimed in claim 3 in which the conveyor belt is substantially impervious to air.

5. In a tobacco processing machine wherein a stream of particulate tobacco is winnowed by projecting said tobacco stream and an airstream respectively along transverse intersecting paths so that said airstream entrains said particulate tobacco in a winnowing zone and means is provided for conveying said particulate tobacco stream along a further path towards said winnowing zone; the improvement comprising sealing means arranged to cooperate with said conveying means to oppose flow of air along said further path towards said winnowing zone whereby disturbance of said particulate tobacco during transport by said conveying means is reduced.

6. A machine as claimed in claim 5 wherein said conveying means comprises means defining a surface for supporting said particulate tobacco and arranged to move along said further path and said sealing means is spaced from said surface of said conveying means such that particulate tobacco supported on said surface of said conveying means is not disturbed by said sealing means but no substantial air flow may occur between said conveying means surface and said sealing means.

7. A machine as claimed in claim 6 wherein said sealing means comprises means defining a continuous surface arranged to move along at least a portion of said further path in the same direction as said conveying means, said continuous surface of said sealing means being spaced from said surface of said conveying means such that particulate tobacco supported on said surface of said conveying means is not disturbed by said continuous surface of said sealing means but no substantial air flow may occur between said surfaces of said sealing and conveying means.

8. A machine as claimed in claim 7 further comprising a housing defined by wall means and containing said winnowing zone, said means defining a surface for supporting said particulate tobacco being arranged to pass through an opening in said wall means, and said sealing means further comprising a flexible seal extending between said housing and said means defining a continuous surface to prevent air flow between said means defining a continuous surface and said housing.

9. A machine as claimed in claim 5 further comprising a housing defined by wall means and containing said winnowing zone, said conveying means comprising a continuous belt having an upper run for supporting said particulate tobacco and arranged to move along said path through an opening in said wall means and said sealing means comprising a rotatably mounted roller having its peripheral surface spaced from said upper run of said continuous belt and a flexible seal extending between said housing and said roller to prevent air flow between said roller and said housing, the spacing between said upper run of said continuous belt and said peripheral surface of said roller being such that particulate tobacco supported on said upper run of said continuous belt is not disturbed by said peripheral surface of said roller but no substantial air flow may occur between said peripheral surface of said roller and said upper run of said continuous belt.

* * * * *